US008535780B2

(12) United States Patent
Wojcik et al.

(10) Patent No.: US 8,535,780 B2
(45) Date of Patent: Sep. 17, 2013

(54) CORELESS TISSUE ROLLS AND METHOD OF MAKING THE SAME

(75) Inventors: Steven James Wojcik, Mosinee, WI (US); Mark R. Verburgt, Omro, WI (US); Joel Banda, Jr., Appleton, WI (US); Kenneth Allen Pigsley, Greenville, WI (US); Christine Ann Armstrong, Neenah, WI (US); Dennis Marvin Jobs, Appleton, WI (US); Thomas Gerard Shannon, Neenah, WI (US); James Leo Baggot, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 707 days.

(21) Appl. No.: 12/574,325

(22) Filed: Oct. 6, 2009

(65) Prior Publication Data

US 2011/0079671 A1 Apr. 7, 2011

(51) Int. Cl.
*D06N 7/04* (2006.01)
*B65H 18/28* (2006.01)

(52) U.S. Cl.
USPC ..... 428/153; 242/160.4

(58) Field of Classification Search
USPC ..... 242/159, 160.4; 428/141, 153, 154, 428/537.5; 162/109, 111, 113
See application file for complete search history.

(56) References Cited

U.S. PATENT DOCUMENTS

| | | | |
|---|---|---|---|
| 125,597 | A | 4/1872 | Mayall |
| 1,648,990 | A | 11/1927 | Little |
| 1,894,253 | A | 1/1933 | McCarthy et al. |
| 2,326,173 | A | 8/1943 | Russell |
| 2,328,582 | A | 9/1943 | Ratchford et al. |
| 2,913,098 | A | 11/1959 | Zellinsky et al. |
| 2,979,278 | A | 4/1961 | Jones |
| 3,123,315 | A | 3/1964 | Couzens |
| 3,148,843 | A | 9/1964 | Turner et al. |
| 3,157,371 | A | 11/1964 | Billingsley |
| 3,315,908 | A | 4/1967 | Wetzler |
| 3,430,881 | A | 3/1969 | Ebneter |
| 3,519,214 | A | 7/1970 | Konrad et al. |
| 3,733,035 | A | 5/1973 | Schott, Jr. |
| RE28,353 | E | 3/1975 | Nystrand et al. |

(Continued)

FOREIGN PATENT DOCUMENTS

| | | |
|---|---|---|
| CH | 476620 | 9/1969 |
| DE | 3920659 A1 | 1/1999 |

(Continued)

OTHER PUBLICATIONS

International Search Report, PCT/IB2010/053910, mailed Apr. 28, 2011.

*Primary Examiner* — William A Rivera
(74) *Attorney, Agent, or Firm* — Dority & Manning, P.A.

(57) ABSTRACT

Coreless tissue rolls can be produced without having to use an adhesive to form a hollow center. Instead, moisture can be used to promote light hydrogen bonding between the layers of the tissue web that line the hollow center. The hydrogen bonding provides sufficient structure to maintain the shape of the hollow center without rendering the tissue web surrounding the passageway unusable. Passageways can also be formed in accordance with the present disclosure that are substantially circular so that the rolls will easily spin on a spindle. In an alternative embodiment, moisture is not used in constructing the wound tissue roll.

18 Claims, 7 Drawing Sheets

(56) References Cited

U.S. PATENT DOCUMENTS

| | | | | |
|---|---|---|---|---|
| 3,869,095 | A | 3/1975 | Diltz | |
| 4,034,928 | A | 7/1977 | McDonald et al. | |
| 4,087,319 | A | 5/1978 | Linkletter | |
| 4,133,495 | A | 1/1979 | Dowd | |
| 4,139,164 | A | 2/1979 | Alfio | |
| 4,143,828 | A | 3/1979 | Braun et al. | |
| 4,191,341 | A | 3/1980 | Looser | |
| 4,283,023 | A | 8/1981 | Braun et al. | |
| 4,327,876 | A | 5/1982 | Kuhn | |
| 4,487,378 | A | 12/1984 | Kobayashi | |
| 4,529,141 | A | 7/1985 | McClenathan | |
| 4,541,583 | A | 9/1985 | Forman et al. | |
| 4,583,698 | A | 4/1986 | Nistri et al. | |
| 4,588,138 | A | 5/1986 | Spencer | |
| 4,723,724 | A | 2/1988 | Bradley | |
| 4,856,725 | A | 8/1989 | Bradley | |
| 4,930,711 | A | 6/1990 | Morizzo | |
| 4,962,897 | A | 10/1990 | Bradley | |
| 4,988,052 | A | 1/1991 | Urban | |
| 5,000,395 | A | 3/1991 | Welp et al. | |
| 5,054,708 | A | 10/1991 | Wiggers | |
| 5,169,084 | A | 12/1992 | Potter et al. | |
| 5,226,612 | A | 7/1993 | Mulfarth | |
| 5,346,150 | A | 9/1994 | Volin | |
| 5,379,964 | A | 1/1995 | Pretto et al. | |
| 5,402,960 | A | 4/1995 | Oliver et al. | |
| 5,421,536 | A | 6/1995 | Hertel et al. | |
| 5,437,417 | A | 8/1995 | Kammann | |
| 5,497,959 | A | 3/1996 | Johnson et al. | |
| 5,505,402 | A | 4/1996 | Vigneau | |
| 5,518,200 | A | 5/1996 | Kaji et al. | |
| 5,531,396 | A | 7/1996 | Kinnunen et al. | |
| 5,593,545 | A | 1/1997 | Rugowski et al. | |
| 5,722,608 | A | 3/1998 | Yamazaki | |
| 5,746,379 | A | 5/1998 | Shimizu | |
| 5,832,696 | A | 11/1998 | Nagy et al. | |
| 5,839,688 | A | 11/1998 | Hertel et al. | |
| 5,901,918 | A | 5/1999 | Klerelid et al. | |
| 5,918,830 | A | 7/1999 | Verajankorva et al. | |
| 5,934,602 | A | 8/1999 | Jendroska et al. | |
| 5,944,273 | A | 8/1999 | Lin et al. | |
| 5,979,818 | A | 11/1999 | Perini et al. | |
| 6,047,916 | A | 4/2000 | Onnerlov | |
| 6,050,469 | A | 4/2000 | Brabant et al. | |
| 6,056,229 | A | 5/2000 | Blume et al. | |
| 6,062,507 | A | 5/2000 | Summey, III | |
| 6,077,590 | A | 6/2000 | Archer et al. | |
| 6,092,759 | A * | 7/2000 | Gemmell et al. | 242/596.8 |
| 6,142,407 | A | 11/2000 | McNeil et al. | |
| 6,264,132 | B1 | 7/2001 | Menz et al. | |
| 6,283,402 | B1 | 9/2001 | Fordham | |
| 6,308,909 | B1 | 10/2001 | McNeil et al. | |
| 6,311,921 | B1 | 11/2001 | Moller et al. | |
| 6,332,589 | B1 | 12/2001 | Moller et al. | |
| 6,523,775 | B2 | 2/2003 | Fan | |
| 6,595,458 | B1 | 7/2003 | Biagiotti | |
| 6,729,572 | B2 | 5/2004 | Baggot et al. | |
| 6,871,814 | B2 | 3/2005 | Daul et al. | |
| 6,877,689 | B2 | 4/2005 | Butterworth | |
| 6,896,767 | B2 | 5/2005 | Wilhelm | |
| 7,000,864 | B2 | 2/2006 | McNeil et al. | |
| 7,175,127 | B2 | 2/2007 | Butterworth et al. | |
| 7,419,570 | B2 * | 9/2008 | Chen et al. | 162/109 |
| 7,691,228 | B2 * | 4/2010 | Edwards et al. | 162/111 |
| 7,874,509 | B2 | 1/2011 | Kenney | |
| 7,884,259 | B2 * | 2/2011 | Hanao et al. | 428/156 |
| 7,909,282 | B2 | 3/2011 | Wojcik et al. | |
| 8,257,551 | B2 * | 9/2012 | Beuther et al. | 162/111 |
| 2003/0160127 | A1 | 8/2003 | Wojcik et al. | |
| 2005/0148261 | A1 | 7/2005 | Close et al. | |
| 2007/0107863 | A1 * | 5/2007 | Edwards et al. | 428/153 |
| 2008/0105776 | A1 | 5/2008 | Wojcik et al. | |

FOREIGN PATENT DOCUMENTS

| | | | |
|---|---|---|---|
| EP | 0118384 | A1 | 9/1984 |
| EP | 0198495 | A2 | 10/1986 |
| EP | 0313859 | A2 | 5/1989 |
| EP | 0408526 | B1 | 1/1991 |
| EP | 0658504 | A2 | 6/1995 |
| EP | 1006066 | A2 | 11/1999 |
| EP | 1076130 | A2 | 2/2001 |
| EP | 1262434 | | 12/2002 |
| EP | 1273540 | | 1/2003 |
| FR | 2669013 | | 5/1992 |
| JP | 09-216755 | | 8/1997 |
| JP | 2001-299632 | | 10/2001 |
| JP | 2003-061861 | | 3/2003 |
| KR | 10-2002-0044137 | | 6/2002 |
| KR | 10-6060303 | B1 | 7/2006 |
| WO | WO 98/52857 | A1 | 11/1998 |
| WO | WO 98/55384 | | 12/1998 |
| WO | WO 00/47503 | | 8/2000 |
| WO | WO 00/66470 | | 11/2000 |
| WO | WO 02/055420 | A1 | 7/2002 |

* cited by examiner

CORELESS TISSUE ROLLS AND METHOD OF MAKING THE SAME

BACKGROUND

Many tissue products, such as bath tissues and paper towels, are manufactured and sold as spirally wound rolls. Typically, the tissue product is wound on a tubular core that is made from a rigid paperboard material. The tubular core is useful since it allows for the product to be dispensed from a holder that is inserted through the tubular core. Bath tissue holders, for instance, typically include a spindle that extends through the hollow core. Once placed on the spindle, the bath tissue roll can be easily unwound and used by the consumer.

Once a spirally wound tissue product is exhausted or consumed, however, the consumer is left with the tubular core that is usually discarded. The tubular core thus not only increases the cost of the tissue product, but also represents waste that has an adverse environmental impact if not recycled.

In the past, those skilled in the art have suggested producing "coreless" tissue products. For instance, coreless rolls of tissue paper are described in U.S. Pat. No. 4,487,378, and U.S. Pat. No. 5,722,608,, which are both incorporated herein by reference. Coreless products proposed in the past, however, have had various disadvantages and drawbacks.

For example, many coreless products produced in the past require an adhesive to be applied to multiple tissue sheets around the opening in the roll. The adhesive is intended to stiffen the tissue sheets immediately near the center of the roll to prevent the product from deforming during use. Placing an adhesive on the tissue sheet, however, adversely affects the product and makes the trailing end of the tissue roll unusable. Thus, a portion of the product is typically discarded representing waste.

Another drawback to past coreless designs is that the opening formed in the product is either very small, is non-existent or is non-circular. Non-circular openings, for instance, do not rotate as easily on spindles. Products having a very small opening or no opening at all, on the other hand, require a special adaptor to dispense the product.

In view of the above, a need currently exists for an improved coreless tissue product and for a process of making the product.

SUMMARY

In general, the present disclosure is directed to a coreless tissue product and to a process for producing the product. The coreless rolls of the present disclosure, in one embodiment, are made from a spirally wound tissue sheet that defines a hollow passageway through the center of the roll. The passageway is lined only by the tissue sheet itself. The passageway can be substantially circular. As used herein, the phrase "substantially circular" means that the circumference of the passageway is free of any cornered or roundness constrictions and is free of any inwardly bulged portions. In one embodiment, for instance, the circumference of the passageway can have a radius that varies by no more than about 25%, such as no more than about 20%, such as no more than about 15%, such as no more than about 10%.

Of particular advantage, the passageway can be formed in the spirally wound roll without using a core and without using an adhesive that adheres the inner layers together. In the past, for instance, various types of adhesives, such as starch adhesives, were used to form hollow passageways without the use of a core. Unfortunately, however, the adhesive rendered the end of the roll unusable. Thus, even though a core was not used to form the product, waste was still produced. The present disclosure has found a way to solve the above problem.

In one embodiment, for instance, the present disclosure is directed to a tissue product comprising a tissue sheet spirally wound to form a roll. The roll defines an axially passageway that extends from a first end of the roll to a second and opposite end of the roll in a direction perpendicular to the length of the tissue sheet. The passageway is lined only by the tissue sheet and can have a substantially circular cross-sectional shape. The passageway, for instance, may have a diameter of at least about 0.5, inches, such as from about 0.5, inches to about 3, inches in one embodiment. In accordance with the present disclosure, the passageway is formed without any layers of the tissue sheet being adhered together by an adhesive. As used herein, the term "adhesive" refers to a substance, such as a paste, hotmelt polymer, or the like that is sticky or has tack and that causes two surfaces to stick together.

In one embodiment, for instance, the inner layers of the roll that line the passageway can be lightly bonded together using only hydrogen bonding. Any suitable method or technique can be used in order to create hydrogen bonds in between the inner layers. In one embodiment, for instance, moisture can be introduced in between the inner layers in a manner that promotes hydrogen bonding. As used herein, moisture is not considered an adhesive.

Of particular advantage, the last sheets or panels on a tissue roll made in accordance with the present disclosure that line the passageway are useable by the consumer. In particular, the roll is constructed such that the physical properties of the last sheets are substantially the same as the tissue sheets on the remainder of the roll. For example, the last five sheets, the last two sheets and even the last sheet in the tissue roll can have physical properties that vary by less than 50%, such as by less than 30%, such as less than about 20%, such as even less than about 10% in comparison to the other sheets in the roll. The physical properties that remain substantially unchanged may include stiffness, tensile strength (Geometric Mean Tensile strength), absorbency, or mixtures thereof.

The absorption capacity of tissue products may be determined according to the following procedure. A pan large enough to hold water to a depth of at least 2 inches (5.08 cm) is filled with distilled water. A balance, such as the OHAUS GT480 balance, is utilized in addition to a stopwatch. A cutting device, such as that sold under the trade designation TMI DGD by Testing Machines, Inc., of Amityville, N.Y., and a die with dimensions of 4 inches by 4 inches (.+−.0.01 inches) (10.16 cm by 10.16cm .+−.0.25 cm) are also utilized. Specimens of the die size are cut and weighed dry to the nearest 0.01 gram. The stopwatch is started when the specimen is placed in the pan of water (or oil) and soaked for 3 minutes .+−.5 seconds. At the end of the specified time, the specimen is removed by forceps and attached to a hanging clamp to hang in a "diamond" shaped position to ensure the proper flow of fluid from the specimen. In addition, the specimen is hung in a chamber having 100 percent relative humidity for 3 minutes .+−.5 seconds. The specimen is then allowed to fall into the weighing dish upon releasing the clamp. The weight is then recorded to the nearest 0.01 gram. The absorbent or absorptive capacity of each specimen is then calculated as follows: Absorbent Capacity (g)=Wet weight (g)-Dry weight (g)

This gives an absorption capacity in grams for the sample which is often reported per weight of sample, giving a specific absorption capacity with units of grams absorbed per grams of sample.

The stiffness of a tissue product may be measured according to the "cup crush" test. The cup crush test evaluates fabric stiffness by measuring the peak load (also called the "cup crush load" or just "cup crush") required for a 4.5, cm diameter hemishperically shaped foot to crush a 23, cm by 23, cm piece of fabric shaped into approximately 6.5, cm diameter by 6.5, cm tall inverted cup while the cup shaped fabric is surrounded by an approximately 6.5, cm diameter cylinder to maintain a uniform deformation of the cup shaped fabric. An average of 10 readings is used. The foot and the cup are aligned to avoid contact between the cup walls and the foot which could affect the readings. The peak load is measured while the foot is descending at a rate of about 0.25, inches per second (380, mm per minute) and is measured in grams. The cup crush test also yields a value for the total energy required to crush a sample (the cup crush energy) which is the energy from the start of the test to the peak load point, i.e. the area under the curve formed by the load in grams on the one axis and the distance the foot travels in millimeters on the other. Cup crush energy is therefore reported in g*mm. Lower cup crush values indicate a softer laminate. A suitable device for measuring cup crush is a model FTD-G-500, load cell (500, gram range) available from the Schaevitz Company of Pennsauken, N.J.

In general, any suitable tissue sheet may be formed into a product in accordance with the present disclosure. The tissue sheet, for instance, may comprise, a bath tissue, a paper towel, a napkin, a facial tissue, or the like. In one embodiment, the tissue sheet has a bulk greater than about 3, cc/g, such as from about 3, cc/g to about 15, cc/g and contains pulp fibers in an amount of at least about 50% by weight, such as an amount of at least about 80% by weight. In one embodiment, for instance, the tissue sheet can be made entirely from pulp fibers.

The basis weight of the tissue sheet can vary depending upon the particular product. The basis weight of the tissue sheet can range, for instance, from about 8 gsm to about 120, gsm. In one embodiment, for instance, the tissue sheet can have a basis weight of from about 8, gsm to about 30, gsm. In an alternative embodiment, the basis weight of the tissue sheet can be from about 25, gsm to about 80, gsm.

The tissue sheet can also include lines of perforation that allow a user to detach a portion of the tissue sheet from the rest of the roll. For instance, in one embodiment, the tissue sheet can define a plurality of perforation lines that extend perpendicular to the length of the tissue sheet and that are spaced at regular intervals.

Tissue sheets can be one ply or multiple plies and sheets of multiple plies can be formed from the same sheet or different sheets. Since sheets have two surfaces which may be different multi ply sheets can be oriented such that one or more similar surfaces are in contact with each other on the roll. Plies can be substantially loose or have been mechanically or chemically attached to one another.

The tissue sheet can be dispensed from the spirally wound roll by unwinding the tissue sheet from the outside of the roll or by unwinding the tissue sheet from the inside of the roll through the passageway. When dispensed from the passageway, for instance, the tissue sheet can include a trailing edge that is adhesively secured to the outside surface of the roll. The leading edge of the tissue sheet, however, can define a tab that is located within the passageway. The user can pull on the tab in order to dispense the product from the passageway. When dispensed from the passageway, the product is referred to as a "center pull" product.

Tissue products made in accordance with the present disclosure can be produced using various methods and techniques. In one embodiment, for instance, the products are made by wetting a leading edge or near the leading edge of a tissue sheet with an aqueous solution. In accordance with the present disclosure, the solution can be adhesive-free or may contain a very light adhesive.

The leading edge of the tissue sheet is contacted with a mandrel that is rotated in order to wind the tissue sheet into a roll. In one embodiment, winding of the tissue sheet onto the mandrel can occur without having to slow down the mandrel or slow the tissue sheet as it is moving towards the mandrel. In addition, winding on the mandrel can occur without having to first wrap the sheet around the mandrel. Once the roll is formed, the tissue sheet is cut to complete the roll and the roll is stripped from the mandrel. The finished roll defines an axially passageway that extends from a first end of the roll to a second and opposite end of the roll. The passageway is lined only by the tissue sheet. Due to the aqueous solution, the inner layers of the tissue sheet are lightly adhered together by hydrogen bonds. The hydrogen bonds provide structure to the passageway so that the tissue sheet does not unravel once removed from the mandrel.

In one embodiment, the tissue sheet is conveyed on a belt for initial contact with the mandrel. The mandrel is accelerated to a rotational speed that is equal to or greater than the speed at which the tissue sheet is moving on the belt. The tissue sheet can be contacted with the aqueous solution prior to contact with the rotating mandrel. For instance, in one embodiment, the aqueous solution can be sprayed onto the tissue sheet.

In order to prevent the tissue sheet from breaking during winding, very low tension can be applied to the tissue sheet during the winding process. For example, in one embodiment, the roll can be wound by not only rotating a mandrel but also by engaging the exterior surface of the roll with a moving belt during winding. In this manner, the roll is wound using a combination of center winding and surface winding. By using center winding and surface winding, the tissue sheet can be wound into a roll under substantially no tension. For instance, the tension maintained on a tissue sheet during formation of the roll can be less than about 0.2, lbs per linear inch, such as less than about 0.1, lbs per linear inch. In fact, in one embodiment, the roll can be wound at substantially no tension.

Since the tissue sheet can be wound at substantially no tension, relatively weak sheets can be used to produce rolls in accordance with the present disclosure. Having the capability to wind relatively weak sheets in accordance with the present disclosure enables the production of tissue products having very soft qualities and properties. Generally speaking, reducing the strength of a tissue sheet results in increasing softness. For example, in one embodiment, the wound product may comprise a single ply or multi-ply tissue, such as a bath tissue. The tissue, for instance, can have a geometric mean tensile strength (GMT) of less than about 1200, g/3". For instance, in one embodiment, the tissue sheet can have a basis weight of from about 10, gsm to about 45, gsm and can have a GMT of from about 500, g/3" to about 1000, g/3", such as from about 500, to about 900, g/3", such as from about 550, g/3" to about 850, g/3".

As used herein, GMT is measured using the following procedure:

The tensile test is performed using tissue samples that are conditioned at 23° C.+/−1° C. and 50% +/−2% relative humidity for a minimum of 4, hours. The samples are cut into 3, inch wide strips in the machine direction (MD) and cross-machine direction (CD) using a precision sample cutter, such as model JDC 15M-10, available from Thwing-Albert Instruments, a business having offices located in Philadelphia, Pa., U.S.A.

The gauge length of the tensile frame is set to four inches. The tensile frame is an Alliance RT/1, frame run with TestWorks 4, software or equivalent. The tensile frame and the software are available from MTS Systems Corporation, a business having offices located in Minneapolis, Minn., U.S.A.

A 3" strip is then placed in the jaws of the tensile frame and subjected to a strain applied at a rate of 25.4, cm per minute until the point of sample failure. The stress on the tissue strip is monitored as a function of the strain. The calculated outputs included the peak load (grams-force/3", measured in grams-force), the peak stretch (%, calculated by dividing the elongation of the sample by the original length of the sample and multiplying by 100%), the % stretch @ 500, grams-force, the tensile energy absorption (TEA) at break (grams-force*cm/$cm^2$, calculated by integrating or taking the area under the stress-strain curve up the point of failure where the load falls to 30% of its peak value), and the slope A (kilograms-force, measured as the slope of the stress-strain curve from 57-150, grams-force).

Each tissue code (minimum of five replicates) is tested in the machine direction (MD) and cross-machine direction (CD). Geometric means of the tensile strength and tensile energy absorption (TEA) are calculated as the square root of the product of the machine direction (MD) and the cross-machine direction (CD) and is reported in units of g/3". This yields an average value that is independent of testing direction.

BRIEF DESCRIPTION OF THE DRAWINGS

A full and enabling disclosure of the present invention, including the best or preferred mode thereof, directed to one of ordinary skill in the art, is set forth more particularly in the remainder of the specification, which makes reference to the appended figure in which.

Figure 1:
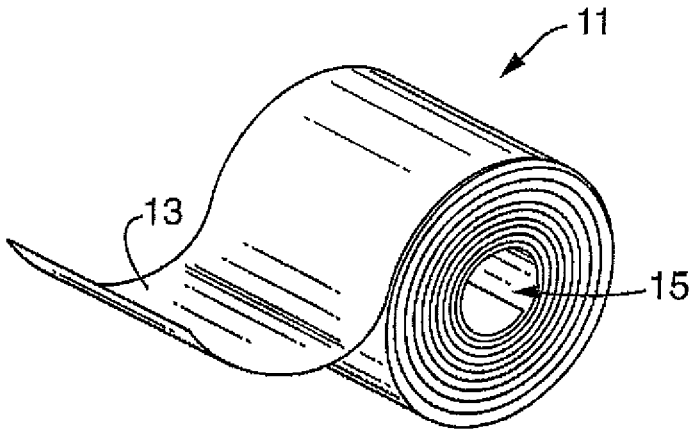
FIG. 1 is a perspective view of one embodiment of a tissue product made in accordance with the present disclosure.

Repeat use of reference characters in the present specification and drawings is intended to represent same or analogous features or elements of the invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to the production of "coreless" tissue rolls, meaning tissue rolls that do not contain a separate core made from a different material, such as paperboard. Eliminating a core provides various advantages and benefits. For example, the core and the adhesives used with the core can represent a significant portion of the cost of the product that is typically discarded when the tissue product is exhausted. Being able to form tissue products without a core thus not only reduces the cost of the product but also makes the products more environmentally friendly.

Of particular advantage, coreless tissue products can be made in accordance with the present disclosure without having to use an adhesive to form a pseudo-core out of the tissue sheet itself. As will be described in greater detail below, the tissue rolls are produced under low or no tension with the use of moisture, such as a fine spray of water, to form a pseudo-core and to maintain a passageway for receiving a spindle during use of the product. The use of water to form the pseudo-core, instead of an adhesive, does not significantly degrade the feel of the tissue sheet preserving the last sheets on the roll for use. Although water can impact the strength of the tissue sheet, the sheet is wound under very low tension so that the fine spray of water applied to the tissue sheet does not cause the sheet to tear or otherwise fail. The water, in turn, lightly bonds the adjacent layers of the tissue sheet together that are used to line the passageway formed into the rolls.

One embodiment of a tissue product made in accordance with the present disclosure is illustrated in FIG. 1. In particular, in FIG. 1, a bath tissue roll 11 is comprised of a tissue sheet 13 that has been spirally wound into a roll. As shown, the roll defines a passageway 15 that defines the circumferential center of the roll. The passageway 15 can be symmetric about the axis of the roll.

In accordance with the present disclosure, as shown in FIG. 1, the tissue roll 11 is coreless in that the passageway is only lined by the tissue sheet itself. In order to form the passageway 15, the layers of the tissue sheet lining the passageway are lightly bonded together through hydrogen bonding. Hydrogen bonding can maintain the structure of the passageway 15 without destroying the characteristics of the tissue sheet. Thus, tissue rolls made according to the present disclosure can be completely consumed by the user without creating any waste.

Of particular advantage, the present inventors unexpectedly discovered that sufficient hydrogen bonding can be created using only moisture and without having to apply significant amounts of compression to the roll as it is being wound. In this regard, hydrogen bonding can be used to maintain the integrity of the roll even when producing rolls having a relatively low firmness.

If desired, the tissue sheet 13 of the bath tissue roll 11 can include perforation lines. The perforation lines, for instance, can run in a direction that is perpendicular to the length of the tissue sheet. The perforation lines can be present at regular intervals. Perforation lines make it easy for the user to tear off a desired piece or panel of the tissue sheet as it is dispensed from the roll.

Figure 2:
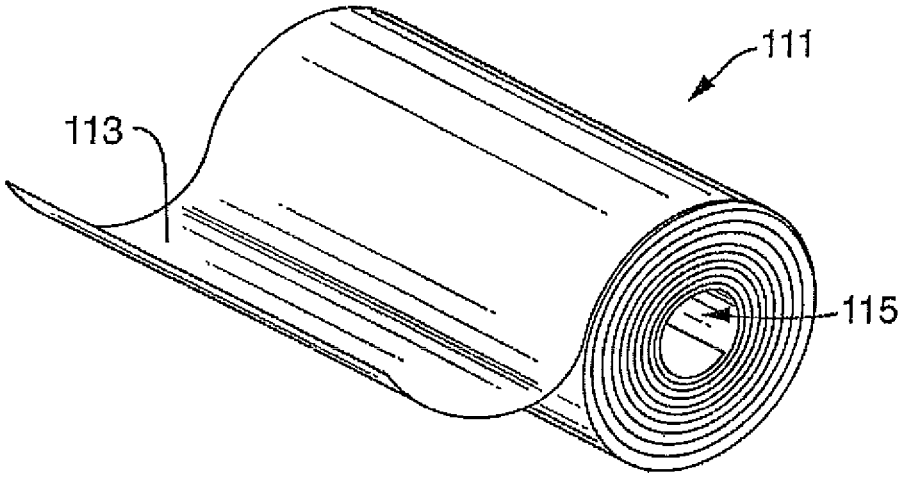
FIG. 2 is a perspective view of another embodiment of a tissue product made in accordance with the present disclosure.

In addition to bath tissue rolls, the present disclosure can also be used to construct various other tissue products. For instance, referring to FIG. 2, a roll of paper towels or napkins 111 is shown. The roll 111 is comprised of a tissue sheet 113 that has been spirally wound together. The roll defines an axial passageway 115 that is lined exclusively by the tissue sheet itself. As described above, hydrogen bonding is used to form the passageway in the product without adversely affecting the properties of the tissue sheet.

When containing a passageway, the diameter of the passageway formed into tissue rolls made in accordance with the present disclosure can vary depending upon the particular application and the desired result. In general, the passageway has a diameter of at least about 0.5, inches, such as from about 0.5 inches to about 3, inches, such as from about 1, inch to about 3, inches. The passageway can be formed so as to have a substantially circular shape and can have a size suitable to accommodate a spindle.

In an alternative embodiment, however, the tissue roll can be formed so as to have substantially no passageway. For instance, a passageway may not be needed if the tissue sheet is to be dispensed from the center of the roll or if the roll is not to be otherwise dispensed from a spindle.

Tissue sheets made in accordance with the present disclosure generally contain a substantial amount of pulp fiber. For instance, the tissue sheets, contain pulp fibers in the amount of at least about 50% by weight, such as an amount of at least 80% by weight. In one embodiment, for instance, the tissue sheets can consist essentially of pulp fibers.

Tissue rolls made in accordance with the present disclosure generally dispense dry products that only contain ambient amounts of moisture. The tissue sheets generally have a bulk of at least 3, cc/g, such as about 5, cc/g to about 15 cc/g. The tissue sheets can have a basis weight from about 8, gsm to about 80 gsm depending upon the particular application. For example, bath tissue generally has a basis weight of from about 8, gsm to about 45, gsm. Paper towels, napkins, industrial wipers, and the like, on the other hand, may have a basis weight of from about 25, gsm to about 80, gsm.

The tissue products of the present disclosure can generally be formed in any of a variety of tissue making processes known in the art. For instance, processes such as through-air drying, adhesive creping, wet creping, double creping, embossing, wet pressing, air pressing, and the like can be used in forming the tissue sheets.

In general, any suitable winding system and process may be used to form tissue rolls in accordance with the present disclosure capable of winding sheets at relatively no tension. In one embodiment, for instance, a winding system as shown in FIGS. 3 through 8 is used.

The winding system, for instance, may comprise a plurality of winding modules that have a rotating mandrel that engages the leading edge of a moving web. The winding system illustrated in the figures can be configured to unwind a parent roll of material and convert the parent roll into a plurality of intermediate rolls or log rolls that are later cut in a perpendicular manner to form a plurality of finished rolls that are then packaged and sold to consumers or otherwise distributed. The parent roll, for instance, can be made directly from a tissue making process. The intermediate or log roll can be cut using any suitable cutting device into a plurality of individual rolls.

As shown in FIGS. 3-8, the winding system includes a plurality of mandrels that are positioned to receive a leading edge of a parent roll being unwound. Upon transfer of the leading edge of the web to the mandrel, the web may be wound by center driving the mandrel. In addition, a moving conveyor or belt that transports the web may apply rotational speed to the outside surface of the roll as it is being formed. In this manner, the roll or log is formed through a combination of center winding and surface winding. Using a combination of both center winding and surface winding allows for the tissue sheet to be wound into a roll under substantially no tension. In addition, rolls can be formed with varying degrees of softness or hardness throughout the roll. For example, in one embodiment, a log or roll can be formed having a denser wind at the passageway compared to the outside of the roll to provide support for the passageway.

Because the tissue sheet can be wound under relatively low tension, rolls can be produced according to the present disclosure from relatively weak materials. For instance, the tissue can have a geometric mean tensile strength of less than about 1200, g/3", such as less than about 1000, g/3", such as less than about 900, g/3", such as less than about 850, g/3". For instance, in one embodiment, the tissue sheet can have a geometric mean tensile strength of from about 500, g/3" to about 1000, g/3". Such sheets can have properties and characteristics that make them very soft to the touch.

Winding systems that may be used in accordance with the present disclosure include the winders disclosed in U.S. Patent Application Publication No. US2003-0160127,, U.S. Patent Application Publication No. US2008-0061182,, and U.S. Patent Application Publication No. US2008-0105776,, which are all incorporated herein by reference.

Figure 3:
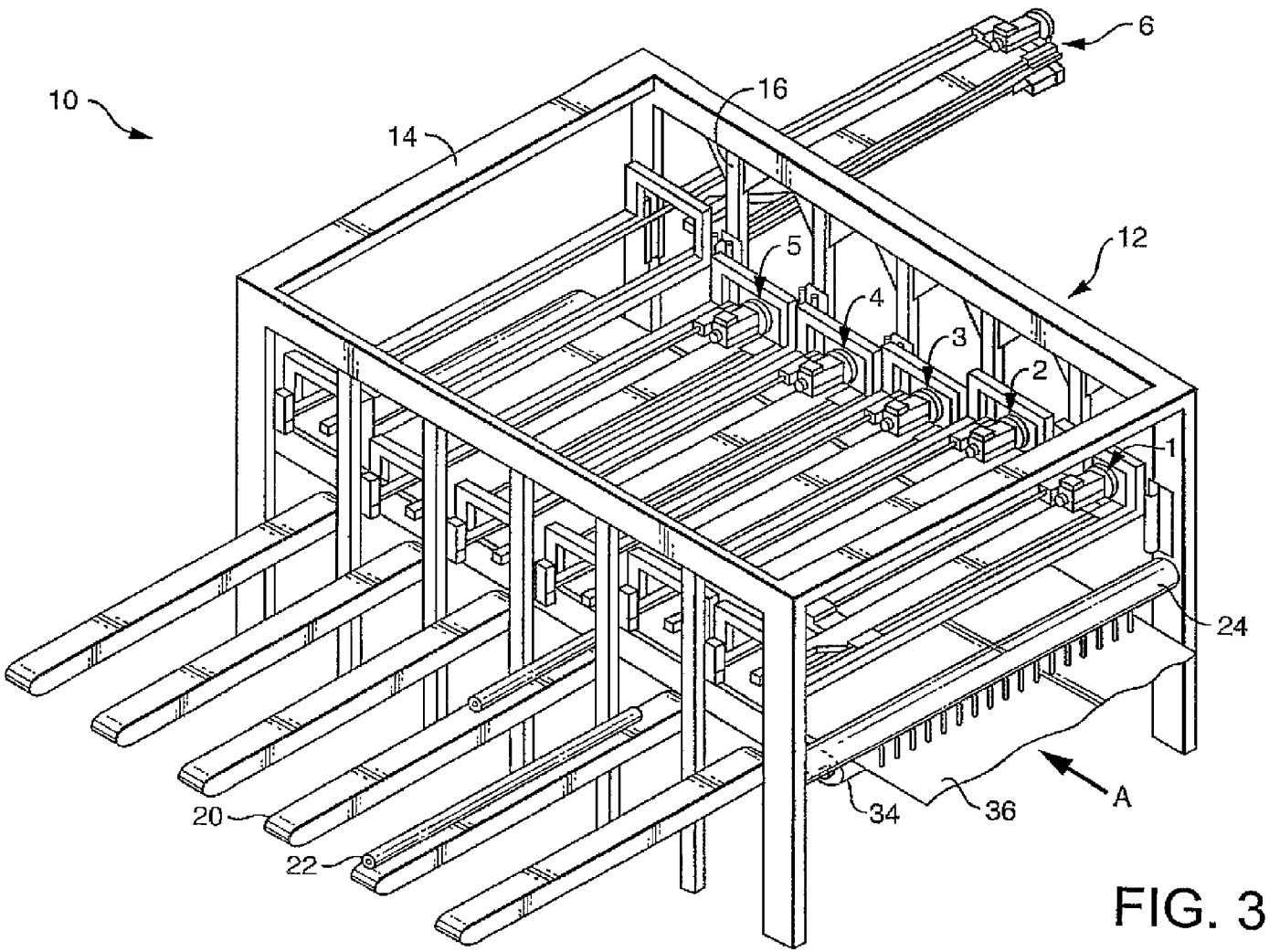
FIG. 3 is a perspective view of one embodiment of a winding system that may be used to produce tissue products in accordance with the present disclosure.
Figure 5:
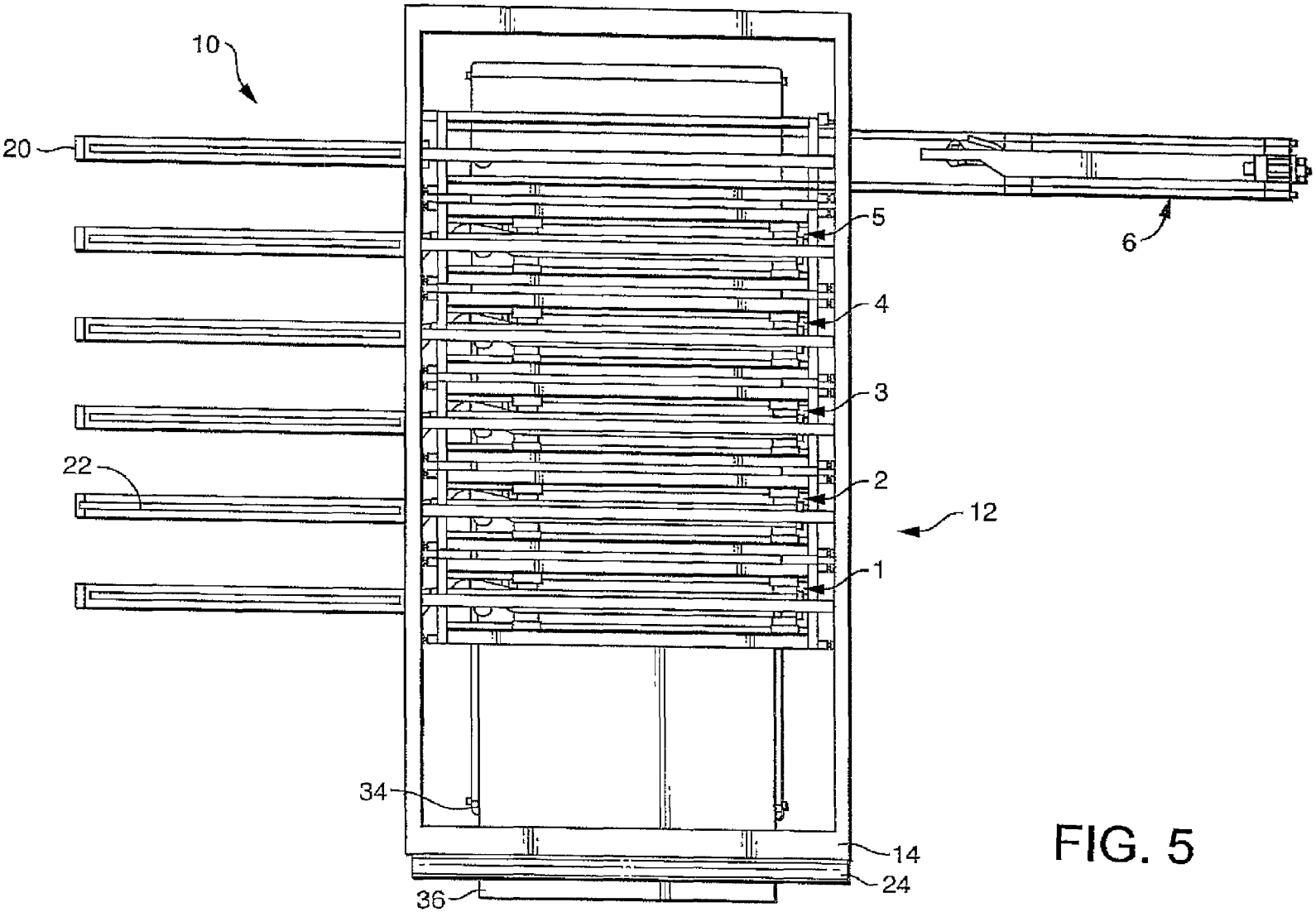
FIG. 5 is a plan view of a winding system illustrated in FIG. 3.

Referring to FIG. 3 and FIG. 5, for instance, a winding system 10 is shown that may be considered a "rewinder" because the system is particularly well suited to unwinding parent rolls and forming multiple smaller rolls for commercial and consumer use via the production of intermediate rolls or logs. As shown, the winding system 10 includes a plurality of independent winding modules 12 arranged in a linear fashion with respect to one another. In the embodiment illustrated, the system includes 6, winding modules, 1, 2, 3, 4, 5 and 6. It should be understood, however, that the system may include more or less winding modules as desired. A frame 14 supports the plurality of independent winding modules 12.

A web transport apparatus 34, such as a belt or a conveyor, is present which transports a tissue sheet or web 36 for eventual contact with the plurality of independent winding modules 12. The frame is composed of a plurality of posts 16 onto which the plurality of independent winding modules 12 are engaged and supported. For example, in the figure, the winding modules are slideably mounted onto the frame 14. The frame 14 may also be comprised of modular frame sections that engage each other to form a rigid structure. The number of modular frame sections may coincide with the number of winding modules utilized.

Figure 4:
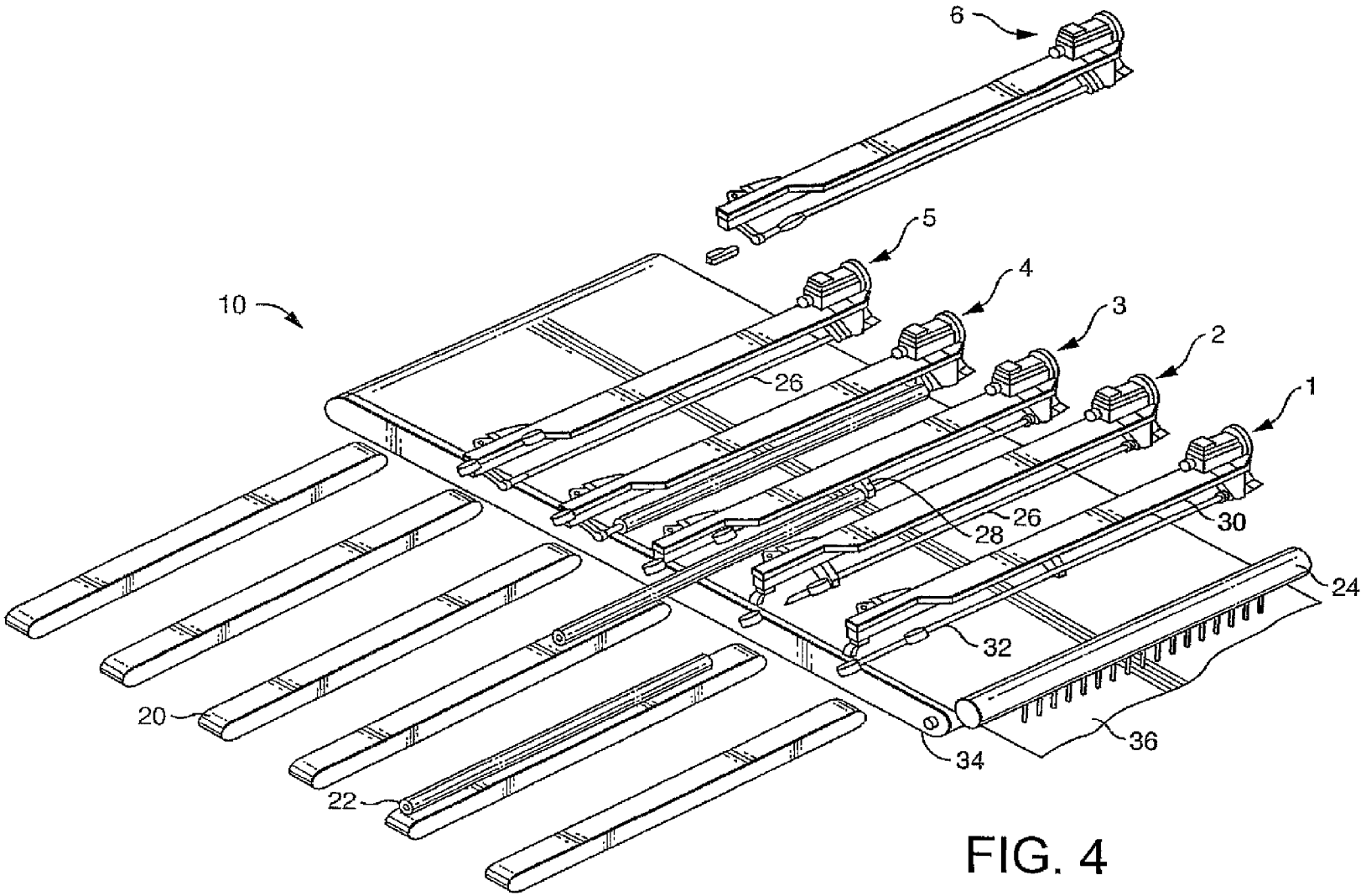
FIG. 4 is a perspective view of the winding system illustrated in FIG. 3 absent various frame members.

FIG. 4 illustrates the winding system 10 as shown in FIG. 3 but having the frame 14 and other parts removed for clarity. The 6, winding modules 1-6 are shown each performing a different function. Winding module 1 is shown in a process of being ready for receiving the tissue web. In winding module 2, a finished tissue roll 22 or log has just been ejected from a mandrel 26. A roll product 22 or log is placed onto a rolled product transport apparatus 20.

Referring to winding module 3, a finished tissue roll or log 22 is shown in the process of being ejected or stripped from a mandrel 26. In order to eject a formed roll, each winding module 12 can include a product stripping apparatus 28. the product stripping apparatus 28 can include, for instance, a flange which stabilizes the mandrel 26 and contacts an end of the rolled product 22 and pushes the log 22 off of the mandrel 26. The rolled product stripping apparatus 28, for instance, can comprise a mechanical apparatus that moves in the direction of the rolled product transport apparatus 20. It should be understood, however, that the product stripping apparatus 28 may be configured differently in other exemplary embodiments.

The winding module 4 as illustrated in FIG. 4 is shown in the process of winding the web 36 in order to form a log roll 22. As described above, the tissue rolls can be formed using a combination of center winding and surface winding. In particular, the mandrel 26 can be driven while the belt 34 simultaneously winds the outside of the roll.

Winding module 5 is shown in the position where it is ready to wind the tissue web once the winding module 4 finishes winding the tissue web 36 to produce a rolled product 22. Winding module 6, on the other hand, is shown in a "racked out" position. As shown, each winding module may be slid or disengaged from the moving conveyor 34 in order to service the winding module or to provide routine inspection. As such, the winding module 6 is not in a position to wind the web 36 to produce a rolled product. The other 5 winding modules, however, are still able to function without interruption to produce rolled products while winding module 6 is being serviced. Of particular advantage, tissue rolls or logs may be formed using the winding system illustrated in FIG. 4 without interruption even if one of the winding modules becomes disabled, there is a web break or in between winding separate rolls.

Figure 6:
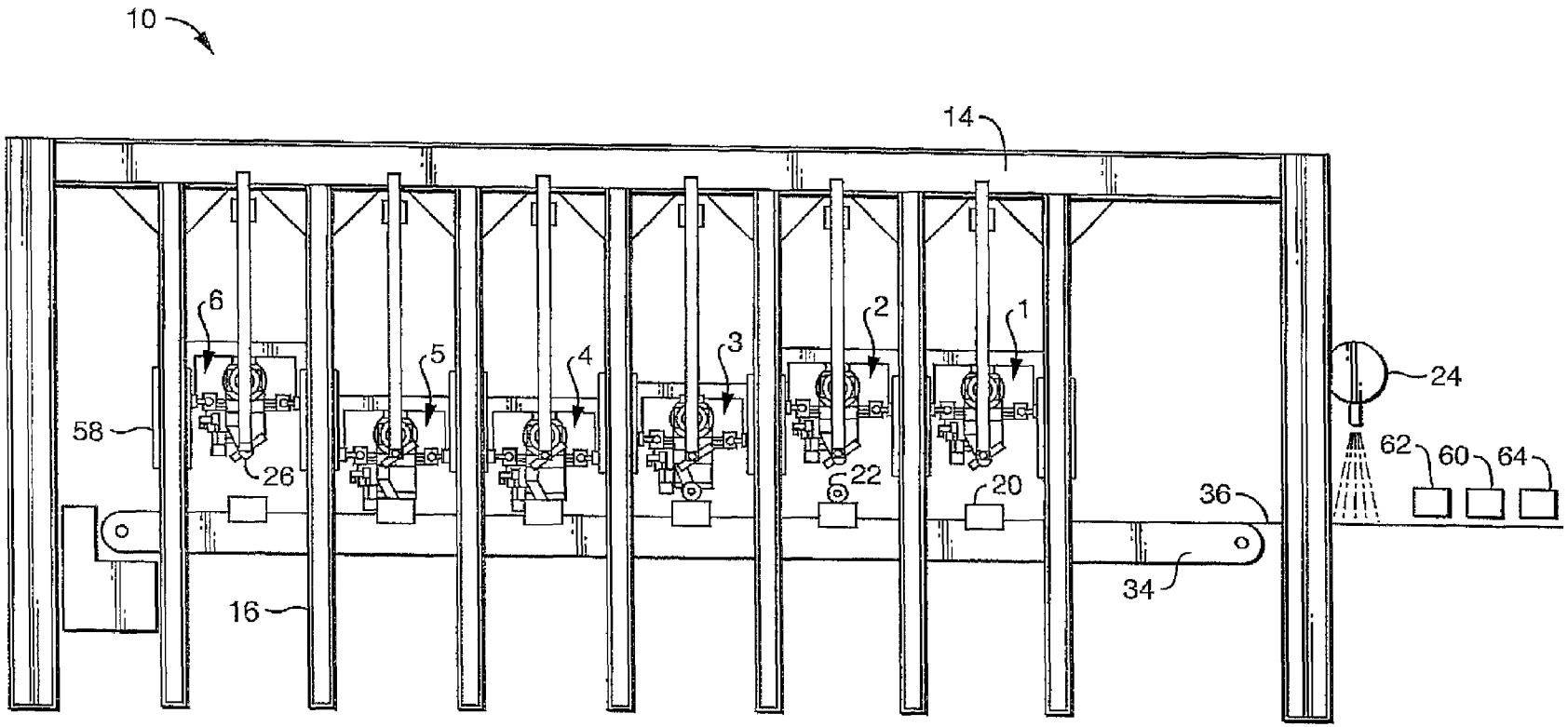
FIG. 6 is a side view of the winding system illustrated in FIG. 3.

The winding of a roll or log of material will now be described with reference to FIGS. 6 through 8. Referring to FIG. 6, the tissue web 36 is shown being transported by the web transport apparatus 34. After a tissue roll has been formed, the web is cut by the use of any suitable cut-off module 60. In one embodiment, for instance, the cut-off module 60 may comprise a pinch bar as disclosed in U.S. Pat. No. 6,056,229. However, any other suitable way to cut the web 36 to desired length may be employed. For example, another embodiment of a cut-off module 60 that may be used is described in U.S. Patent Application Publication No. US2008-0061182,, which is incorporated herein by reference.

As shown in FIG. 6, the winding system 10 can also include a perforation module 64 that can create perforation lines in the moving tissue sheet 36. The perforation lines, for instance, can be formed in a direction perpendicular to the length of the tissue sheet and can be spaced apart on the tissue sheet of regular intervals so that the tissue sheet can later be torn based upon consumer preference.

Further, the winding system 10 can include an adhesive applicator module 62. The adhesive applicator module may be configured to apply a relatively small amount of adhesive on a trailing edge of a tissue sheet in order to finish the tissue roll. Adhesive, for instance, is conventionally applied towards the trailing edge of the tissue roll so that the roll remains wound as the roll is later cut and/or packaged.

Figure 7:
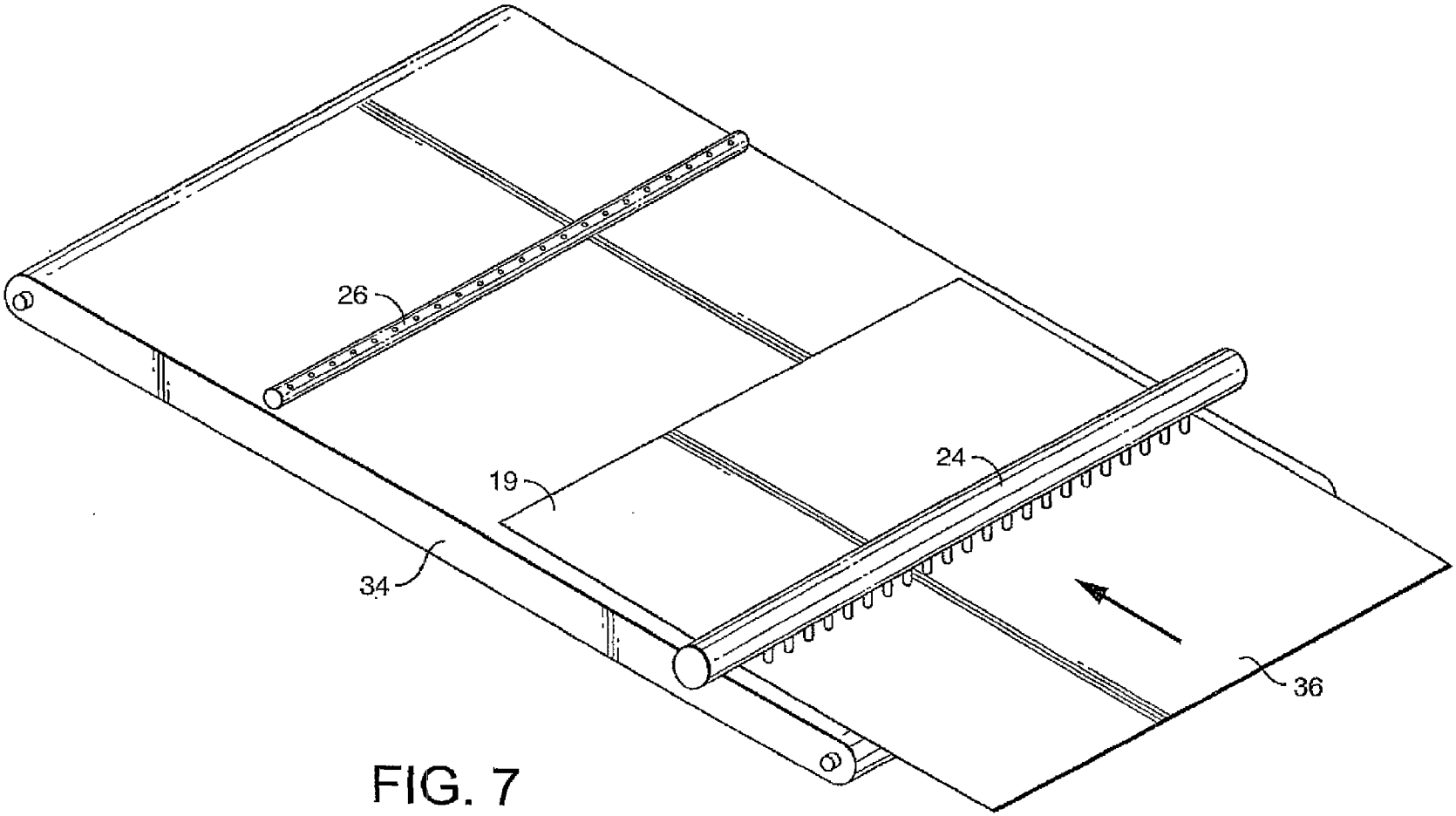
FIG. 7 is a perspective view of a tissue sheet being transported by a web transport apparatus into proximity with a mandrel.
Figure 8:
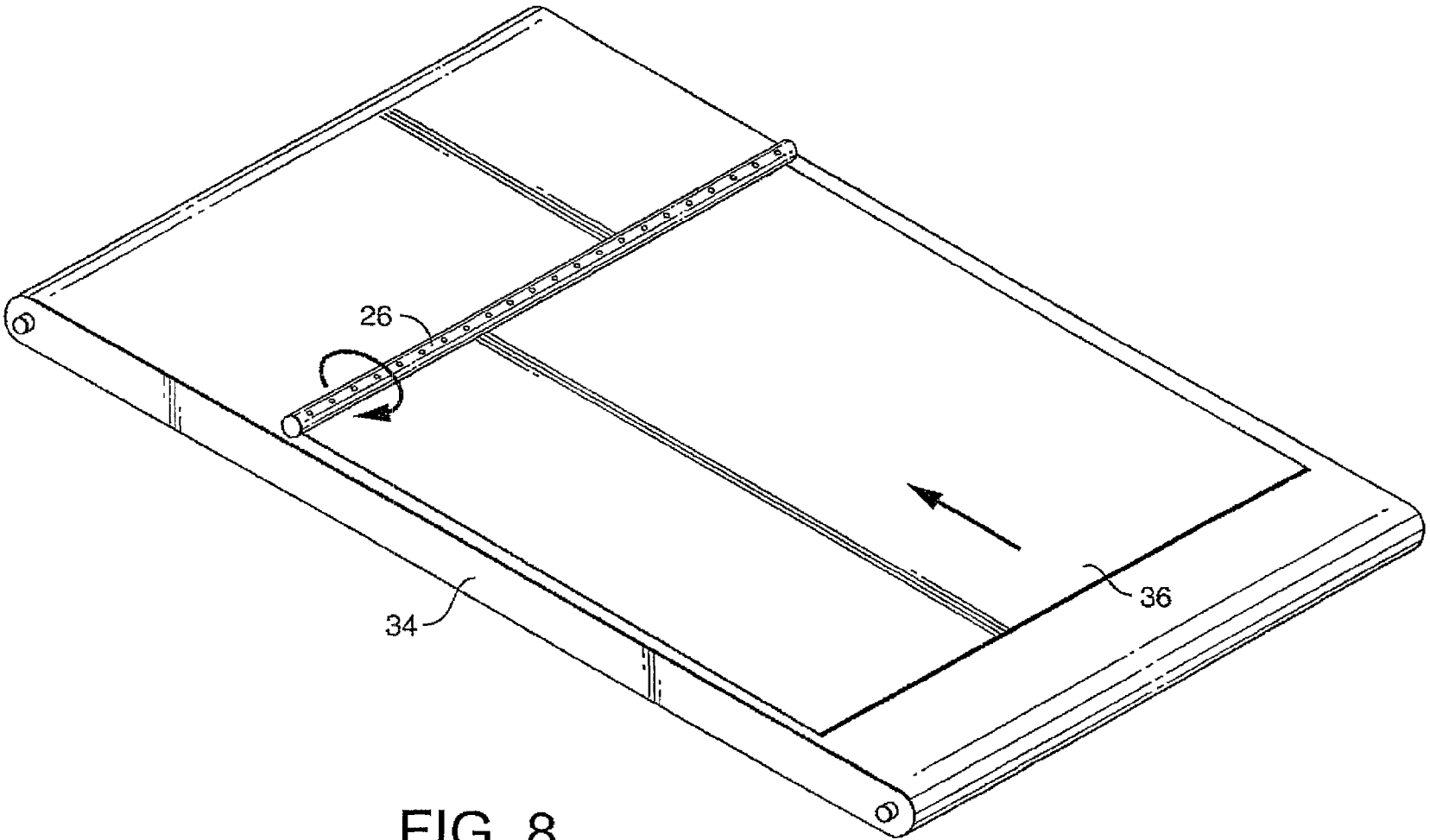
FIG. 8 is a perspective view of a rotating mandrel winding a tissue web into a roll in accordance with the present disclosure.

Referring to FIGS. 7 and 8, the tissue web 36 is shown after being cut to form a leading edge 19. As shown, the tissue web 36 is being conveyed on the web transport apparatus 34.

In accordance with the present disclosure, the winding system 10 further includes a spray device 24 that emits an aqueous solution onto the leading edge 19 of the tissue web 36. The aqueous solution, for instance, can comprise water alone or in combination with other minor ingredients. The aqueous solution, in one embodiment, does not contain an adhesive. In another embodiment, the solution may contain a relatively minor amount of starch.

In accordance with the present disclosure, the leading edge 19 of the tissue web 36 is lightly wetted prior to contact with the mandrel 26. Lightly wetting the tissue web 36 allows for hydrogen bonds to form between the layers of the tissue web that are directly adjacent to the mandrel 26. The light hydrogen bonding allows for a passageway to be formed into the roll or log of material without compromising the tissue web. The layers of the tissue web are lightly bonded such the layers can be separated during later use.

The amount of moisture applied to a tissue web can vary depending upon the particular application and the type of tissue web being wound. In one embodiment, for instance, moisture is applied to the tissue web in an amount of at least about 20% by weight moisture in relation to the total fiber weight of the sheet. For instance, moisture can be applied to the tissue sheet in an amount from about 20% by weight up to about 800% by weight, such as from about 20% by weight to about 400% by weight, such as from about 30% by weight to about 300% by weight of the fibers.

The area of the tissue sheet that is wetted or the length of the tissue sheet that is wetted can also vary depending upon numerous factors. For exemplary purposes only, in one embodiment, moisture can be applied along a length of the tissue sheet of from about 10" to about 80", such as from about 16" to about 50". The aqueous solution can be applied so as to wet the entire width of the sheet or can be applied so as to only wet a portion of the width of the sheet. For instance, from about 20% to about 100% of the width of the sheet can be wetted, such as from about 20% to about 80% of the width of the sheet.

The aqueous solution can be applied directly to the leading edge 19 of the tissue web or can be applied a short distance from the leading edge. When applied a short distance (such as from about 4" to about 20") from the leading edge, for instance, a tab may form within the passageway of the roll that can be easily grasped if it is desired to dispense the tissue sheet from the center of the roll. In one embodiment, the aqueous solution can be applied a short distance from the leading edge without the formation of a tab.

In the embodiment shown in the figures, a spray device is used to apply the aqueous solution to the tissue web. It should be understood, however, that any suitable device capable of applying moisture to the web can be used. For example, in an alternative embodiment, moisture can be applied to the tissue web as a vapor. In still other embodiments, the aqueous solution can be dripped on to the tissue web or can be applied to the tissue web using any suitable printer, such as an ink jet printer or a flexographic printer. Further, the moisture can be applied continuously across the width of the tissue web or can be applied at discrete locations.

Once moisture has been applied to the tissue web 36, the tissue web then engages the mandrel 26 for winding on the mandrel. In one embodiment, the mandrel 26 is accelerated prior to contact with the tissue web 36. The mandrel 26, for instance, can be accelerated to a speed that substantially matches the speed of the web 36. For instance, the mandrel may be rotated at a speed that is equal to, slightly greater than or slightly less than the speed of the moving web. As used herein, for instance, indicating that the mandrel is accelerated to a rotational speed that is "substantially" equal to a speed at which the tissue sheet is moving refers to the fact that the mandrel speed is within about 10% of the speed of the tissue sheet. In other embodiments, however, the mandrel speed may be within about 5%, such as within about 2% of the speed of the tissue sheet. In still another embodiment, the mandrel may be accelerated so as to be at the same speed or slightly greater than the speed of the tissue web.

In order to assist in placing the tissue web on the mandrel, in one embodiment, the mandrel may include a plurality of openings and may be in communication with a vacuum source. In this manner, the mandrel forms a suction against the tissue web in order to at least initiate winding.

Although unnecessary, in one embodiment, gas flow can be then reversed in order to assist in stripping the finished log or roll off of the mandrel. For instance, gas can be pushed out from the mandrel against the finished roll so that the roll can be easily stripped from the mandrel. Alternatively or in addition, a lubricant can be applied to the mandrel and/or to the roll.

Referring to FIG. 8, the tissue web 36 is shown being wound onto the mandrel 26. The winding of the web 36 on to the mandrel may be controlled by not only center driving the mandrel but also pressing the roll into contact with the web transport apparatus 34 to form a nip.

The magnitude with which the roll is pressed into engagement with the web transport apparatus 34 creates a nip pressure that can be used to control tension in the web as the web is being wound. Tension can also be controlled by controlling the torque of the driven mandrel 36. Thus, nip distance and torque differential can be employed in order to wind the web at low tension.

Winding the web at low tension, for instance, may be advantageous in certain embodiments. For instance, depending upon the tissue web being wound, contacting the web with moisture may weaken the web where the web is wetted. Winding the web under substantially no tension, however, prevents the web from breaking during formation of the coreless roll. The tissue web 36, for instance, can be wound into a roll while all tension in the web reaches no greater than 0.2, lbs per linear inch, such as no greater than 0.1, lbs per linear inch. For instance, in one embodiment, the tissue web can be wound at essentially no tension.

Although moisture can be used to lightly bond the tissue sheet together to form a core, in other embodiments, a rolled tissue product can be produced that is not treated either with moisture or an adhesive. In this embodiment, for instance, the roll is produced without treating the roll with any foreign material. Thus, the tissue sheet is wound into a roll in a dry state.

Forming a roll without treating the tissue sheet with moisture, for instance, can be used to produce a solid roll of material that does not include a clearly defined hollow passageway. In this embodiment, the tissue sheet may be wound at higher tensions since moisture is not applied.

Once a tissue roll 22 has been formed on the mandrel, the web is then cut using any suitable device. A cutting mechanism can be used, for instance, that also does not create any tension in the web. For instance, the web can be cut at a tension of less than about 0.2, lbs per linear inch, such as less than 0.1, lbs per linear inch. The trailing edge of the tissue web may be contacted with a small amount of adhesive for finishing the roll. The roll is then stripped off the mandrel, sent to a cutting process for cutting the roll or log into desired widths, and then packaged.

By using the winding system 10 as shown in the figures various different rolled products can be formed having varying characteristics. For instance, the characteristics of the formed rolls can be changed by changing the tension on the web during winding. For example, low density softer rolled products can be produced or higher density, harder wound products can be made. In general, lower density softer rolled products give the impression of a softer, more premium quality product.

When forming soft products, for instance, tissue rolls can be produced that have a Kershaw roll firmness of greater than about 2 mm, such as from about 2 mm to about 14 mm. Kershaw roll firmness is known in the art and can be determined as disclosed in U.S. Pat. Nos. 6,077,590, and 6,896,767. When forming rolls having a lower roll firmness, for instance, the tissue rolls can have a Kershaw roll firmness of greater than about 3 mm, such as having a Kershaw roll firmness of from about 3 mm to about 14 mm.

In still another embodiment, a tissue roll may be produced that has varying firmness based on the radial position. For example, in one embodiment, a coreless product may be produced in which the inner part of the roll near the center is wound tighter than the outer part of the roll. In this manner, a tissue roll may be produced that has a well defined non-deformable center while at the same time having consumer perceived softness due to the compressability of the outer layers.

In one particular embodiment, for instance, the inner part of the roll can have a roll firmness of from about 1 mm to about 4 mm, while the outer part of the roll can have a roll firmness of from about 4 mm to about 14 mm. The inner part of the roll, for instance, may comprise from about 10% to about 50% of the radius of the roll, such as from about 10% to about 30%. The outer part of the roll, on the other hand, may comprise the remainder of the roll.

Ultimately, a coreless tissue product is produced where the tissue layers surrounding the passageway are lightly bonded together in a manner such that the entire length of the tissue web is completely usable by the consumer.

These and other modifications and variations to the present disclosure may be practiced by those of ordinary skill in the art, without departing from the spirit and scope of the present disclosure, which is more particularly set forth in the appended claims. In addition, it should be understood that aspects of the various embodiments may be interchanged either in whole or in part. Furthermore, those of ordinary skill in the art will appreciate that the foregoing description is by way of example only, and is not intended to limit the disclosure so further described in such appended claims.

What is claimed is:

1. A coreless tissue product comprising:

a tissue sheet spirally wound to form a roll, the tissue sheet having a length and a width, the roll defining an axial passageway that extends from a first end of the roll to a second and an opposite end of the roll in a direction perpendicular to the length of the tissue sheet, the passageway being lined only by the tissue sheet, the passageway having a substantially circular cross-sectional shape and having a diameter of at least about 0.5 inches, the tissue sheet comprising a first end, a middle and a second end, the second end lining the passageway, the second end of the tissue sheet having a geometric mean tensile strength, an absorbency, and a stiffness that is within 50% of the geometric mean tensile strength, absorbency, and stiffness of the middle of the tissue sheet and wherein a portion of the tissue sheet lining the passageway is bonded to adjacent layers of the tissue sheet through hydrogen bonding.

2. The coreless tissue product as defined in claim 1, wherein the second end of the tissue sheet has a geometric mean tensile strength, an absorbency and a stiffness that is within 30% of the geometric mean tensile strength, absorbency, and stiffness of the middle of the tissue sheet.

3. The coreless tissue product as defined in claim 1, wherein the second end of the tissue sheet has a geometric mean tensile strength, an absorbency and a stiffness that is within 10% of the geometric mean tensile strength, absorbency, and stiffness of the middle of the tissue sheet.

4. The coreless tissue product as defined in claim 1, wherein the tissue sheet has a bulk greater than about 3 cc/g and contains at least about 80 percent by weight pulp fibers.

5. The coreless tissue product as defined in claim 1, wherein the tissue sheet has a basis weight of from about 8 gsm to about 45 gsm, the tissue sheet having a geometric mean tensile strength of from about 500 g/3" to about 1000g/3" , the spirally wound roll having a Kershaw roll firmness of from about 2 mm to about 14 mm.

6. The coreless tissue product as defined in claim 1, wherein the coreless tissue product comprises a bath tissue having a basis weight of from about 8 gsm to about 45 gsm.

7. The coreless tissue product as defined in claim 1, wherein the coreless tissue product comprises a paper towel having a basis weight of from about 25 gsm to about 80 gsm.

8. The coreless tissue product as defined in claim 1, wherein the axial passageway has a diameter of from about 0.5 inches to about 3 inches.

9. The coreless tissue product as defined in claim 1, wherein the spirally wound roll has a Kershaw roll firmness of greater than about 6 mm.

10. The coreless tissue product as defined in claim 1, wherein the portion of the tissue sheet lining the passageway is bonded to adjacent layers of the tissue sheet only through hydrogen bonding.

11. The coreless tissue product as defined in claim 1, wherein the tissue sheet defines a plurality of perforation lines that extend perpendicular to the length of the tissue sheet and are spaced apart at regular intervals, the perforation lines defining separate panels along the tissue sheet.

12. The coreless tissue product as defined in claim 11, wherein the second end of the tissue sheet comprises the last five panels.

13. The coreless tissue product as defined in claim 11, wherein the second end of the tissue sheet comprises the last two panels.

14. The coreless tissue product as defined in claim 11, wherein the second end of the tissue sheet comprises the last panel.

15. The coreless tissue product as defined in claim 1, wherein the passageway is formed without any layers of the tissue sheet being adhered together by an adhesive.

16. The coreless tissue product as defined in claim 1, wherein the roll includes an inner part and an outer part, the inner part having a Kershaw roll firmness less than the Kershaw roll firmness of the outer part.

17. The coreless tissue product as defined in claim 16, wherein the inner part has a Kershaw roll firmness of less than about 4 mm, while the outer part has a Kershaw roll firmness of greater than about 5 mm.

18. The coreless tissue product as defined in claim 17, wherein the roll has a radius and wherein the inner part of the roll comprises from about 10% to about 30% of the radius.

* * * * *